US009561573B2

(12) United States Patent
Seki et al.

(10) Patent No.: US 9,561,573 B2
(45) Date of Patent: Feb. 7, 2017

(54) POLISHING APPARATUS

(71) Applicant: EBARA CORPORATION, Tokyo (JP)

(72) Inventors: Masaya Seki, Tokyo (JP); Tetsuji Togawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 145 days.

(21) Appl. No.: 14/167,129

(22) Filed: Jan. 29, 2014

(65) Prior Publication Data

US 2014/0213154 A1 Jul. 31, 2014

(30) Foreign Application Priority Data

Jan. 31, 2013 (JP) ..... 2013-017192

(51) Int. Cl.

| | |
|---|---|
| ***B24B 1/00*** | (2006.01) |
| ***B24B 21/00*** | (2006.01) |
| ***B24B 9/06*** | (2006.01) |
| ***B24B 21/18*** | (2006.01) |

(52) U.S. Cl.

CPC ..... *B24B 21/002* (2013.01); *B24B 9/065* (2013.01); *B24B 21/004* (2013.01); *B24B 21/18* (2013.01)

(58) Field of Classification Search

CPC ..... B24B 9/065; B24B 21/002; B24B 21/004; B24B 21/02; B24B 21/08; B24B 21/10; B24B 21/12; B24B 21/14; B24B 21/16; B24B 21/18; B24B 47/26

See application file for complete search history.

(56) References Cited

U.S. PATENT DOCUMENTS

| | | | | |
|---|---|---|---|---|
| 3,415,017 | A * | 12/1968 | Murray | B24B 21/12 451/296 |
| 6,126,512 | A * | 10/2000 | Chao | B24B 21/20 198/810.03 |
| 7,108,582 | B2 * | 9/2006 | Sato | B24B 21/002 451/11 |
| 8,979,615 | B2 * | 3/2015 | Seki | B24B 9/065 451/168 |
| 2012/0244787 | A1 | 9/2012 | Seki et al. | |

FOREIGN PATENT DOCUMENTS

| | | |
|---|---|---|
| JP | 2010-129854 A | 6/2010 |
| JP | 2012-213849 A | 11/2012 |
| JP | 2013-103318 A | 5/2013 |

* cited by examiner

*Primary Examiner* — Timothy V Eley
(74) *Attorney, Agent, or Firm* — Pearne & Gordon LLP

(57) ABSTRACT

A polishing apparatus is used for polishing a substrate such as a semiconductor wafer. The polishing apparatus includes a substrate holder to hold a substrate and to rotate the substrate, a pressing member configured to press a polishing tool against the substrate and to polish the substrate, a pressing force control mechanism configured to control a pressing force of the pressing member, and a polishing position limiting mechanism configured to limit a polishing position of the pressing member. A polishing tape or a fixed abrasive is used as the polishing tool.

12 Claims, 16 Drawing Sheets

POLISHING APPARATUS

CROSS REFERENCE TO RELATED APPLICATION

This document claims priority to Japanese Patent Application No. 2013-17192 filed Jan. 31, 2013, the entire contents of which are hereby incorporated by reference.

BACKGROUND OF THE INVENTION

Field of the Invention

The present invention relates to a polishing apparatus and a polishing method for polishing a substrate, such as a wafer.

Description of the Related Art

From a viewpoint of improving yield in fabrication of semiconductor devices, management of surface conditions of a peripheral portion of a substrate has been attracting attention in recent years. In the fabrication process of the semiconductor devices, various materials are deposited on a silicon wafer to form a multilayer structure. As a result, unwanted films and roughened surface are formed on a peripheral portion of the substrate. It has been a recent trend to transport the substrate by holding only its peripheral portion using arms. Under such circumstances, the unwanted films remaining on the peripheral portion would be peeled off during various processes and could adhere to devices, causing lowered yield. Thus, in order to remove the unwanted films, the peripheral portion of the substrate is polished using a polishing apparatus.

This type of polishing apparatus polishes the peripheral portion of the substrate by bringing a polishing surface of a polishing tape into sliding contact with the peripheral portion of the substrate. In this specification, the peripheral portion is defined as a region including a bevel portion which is the outermost portion of the substrate and a top edge portion and a bottom edge portion located radially inwardly of the bevel portion.

FIG. 1A and FIG. 1B are enlarged cross-sectional views each showing a peripheral portion of a substrate. More specifically, FIG. 1A shows a cross-sectional view of a so-called straight-type substrate, and FIG. 1B shows a cross-sectional view of a so-called round-type substrate. In the substrate W shown in FIG. 1A, the bevel portion is an outermost circumferential surface of the substrate W (indicated by a letter B) that is constituted by an upper slope (an upper bevel portion) P, a lower slope (a lower bevel portion) Q, and a side portion (an apex) R. In the substrate W shown in FIG. 1B, the bevel portion is a portion (indicated by a letter B) having a curved cross section and forming an outermost circumferential surface of the substrate W. A top edge portion is a flat portion E1 located radially inwardly of the bevel portion B. A bottom edge portion is a flat portion E2 located on the opposite side of the top edge portion and located radially inwardly of the bevel portion B. These top edge portion E1 and bottom edge portion E2 may be collectively referred to as edge portions. The edge portions may also include a region where the devices are formed.

The polishing apparatus has a polishing end point detection unit for detecting a polishing end point of the substrate. This polishing end point detection unit is configured to monitor polishing of the substrate based on a polishing index value indicating a film thickness (e.g., polishing time) and determine the polishing end point.

However, the substrate having a multilayer structure includes different kinds of films formed thereon, and these films have different hardness normally. Therefore, if the polishing end point is controlled based on the polishing time, excessive polishing may occur in a soft film and insufficient polishing may occur in a hard film.

In a conventional polishing apparatus, a pressing member of a polishing head is lowered by an air cylinder to press a polishing surface of a polishing tape against the substrate under a predetermined polishing load, as disclosed in Japanese Laid-Open Patent Publication No. 2012-213849. However, since the air cylinder cannot control a lowered position of the pressing member accurately, an error may occur between a target polishing amount and an actual polishing amount of the substrate.

SUMMARY OF THE INVENTION

The present invention has been made in view of the above drawbacks. It is therefore an object of the present invention to provide a polishing apparatus and a polishing method which can control a polishing amount of a substrate accurately.

One aspect of the present invention for achieving the above object is to provide a polishing apparatus for polishing a substrate, including: a substrate holder configured to hold a substrate and to rotate the substrate; a pressing member configured to press a polishing tool against the substrate and to polish the substrate; a pressing force control mechanism configured to control a pressing force of the pressing member; and a polishing position limiting mechanism configured to limit a polishing position of the pressing member.

In a preferred aspect of the present invention, the polishing apparatus further comprises a positioning member coupled to the pressing member, the positioning member and the pressing member being integrally movable; and the polishing position limiting mechanism comprises a stopper configured to limit a movement of the positioning member and a stopper moving mechanism configured to move the stopper.

In a preferred aspect of the present invention, the stopper moving mechanism comprises a ball screw mechanism and a servomotor configured to operate the ball screw mechanism.

In a preferred aspect of the present invention, an alarm signal is generated when the positioning member is not brought into contact with the stopper within a predetermined polishing time.

In a preferred aspect of the present invention, the pressing force control mechanism comprises an air cylinder configured to apply the pressing force to the pressing member.

Other aspect of the present invention is to provide a polishing apparatus for polishing a substrate, including: a substrate holder to hold a substrate and to rotate the substrate; a pressing member to press a polishing tool against the substrate and to polish the substrate; an actuator to control a pressing three of the pressing member; and a position limiter to limit a polishing position of the pressing member.

In a preferred aspect of the present invention, the polishing apparatus further comprises a positioning member coupled to the pressing member, the positioning member and the pressing member being integrally movable; and the position limiter comprises a stopper to limit a movement of the positioning member and an actuator to move the stopper.

In a preferred aspect of the present invention, the actuator to move the stopper comprises a ball screw mechanism and a servomotor to operate the ball screw mechanism.

In a preferred aspect of the present invention, an alarm signal is generated when the positioning member is not brought into contact with the stopper within a predetermined polishing time.

In a preferred aspect of the present invention, the actuator to control the pressing three of the pressing member comprises an air cylinder to apply the pressing force to the pressing member.

Further, other aspect of the present invention is to provide a polishing method of polishing a substrate, including: moving a stopper from a predetermined initial position by a distance corresponding to a target polishing amount of a substrate; pressing a polishing tool against the substrate by a pressing member while rotating the substrate; and polishing the substrate until a positioning member which moves together with the pressing member is brought into contact with the stopper.

In this specification, a polishing amount represents a thickness of a material removed from a surface of a substrate by polishing of the substrate.

In a preferred aspect of the present invention, moving the polishing tool and the stopper integrally; and determining the initial position from a position of the stopper when the polishing tool is brought into contact with the substrate.

In a preferred aspect of the present invention, generating an alarm signal when the positioning member is not brought into contact with the stopper within a predetermined polishing time.

Further, other aspect of the present invention is to provide a polishing method of polishing a substrate, including: bringing a positioning member, which moves together with a pressing member, into contact with a stopper; and polishing the substrate by pressing a polishing tool against the substrate by the pressing member while moving the pressing member and the stopper integrally at a predetermined speed with the positioning member and the stopper being in contact with each other while rotating the substrate.

In a preferred aspect of the present invention, the predetermined speed is a speed corresponding to a target polishing rate of the substrate.

According to the present invention, the polishing position of the pressing member at the time of polishing the substrate is limited by the polishing position limiting mechanism. This limited polishing position can be set based on the target polishing amount of the substrate. Therefore, the polishing amount of the substrate can be accurately controlled by the polishing position limiting mechanism.

DETAILED DESCRIPTION

Figure 1A:
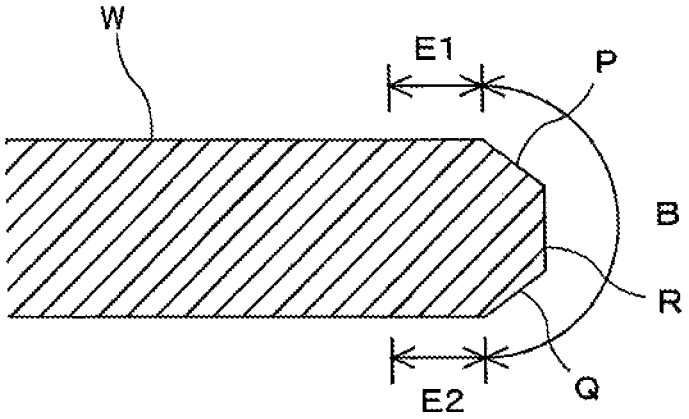
FIGS. 1A and 1B are enlarged cross-sectional views each showing a peripheral portion of a substrate.

Embodiments of a polishing apparatus and a polishing method according to the present invention will now be described in detail with reference to the drawings. Identical or corresponding parts are denoted by identical reference numerals in FIGS. 2 to 16, and will not be described in duplication.

Figure 2:
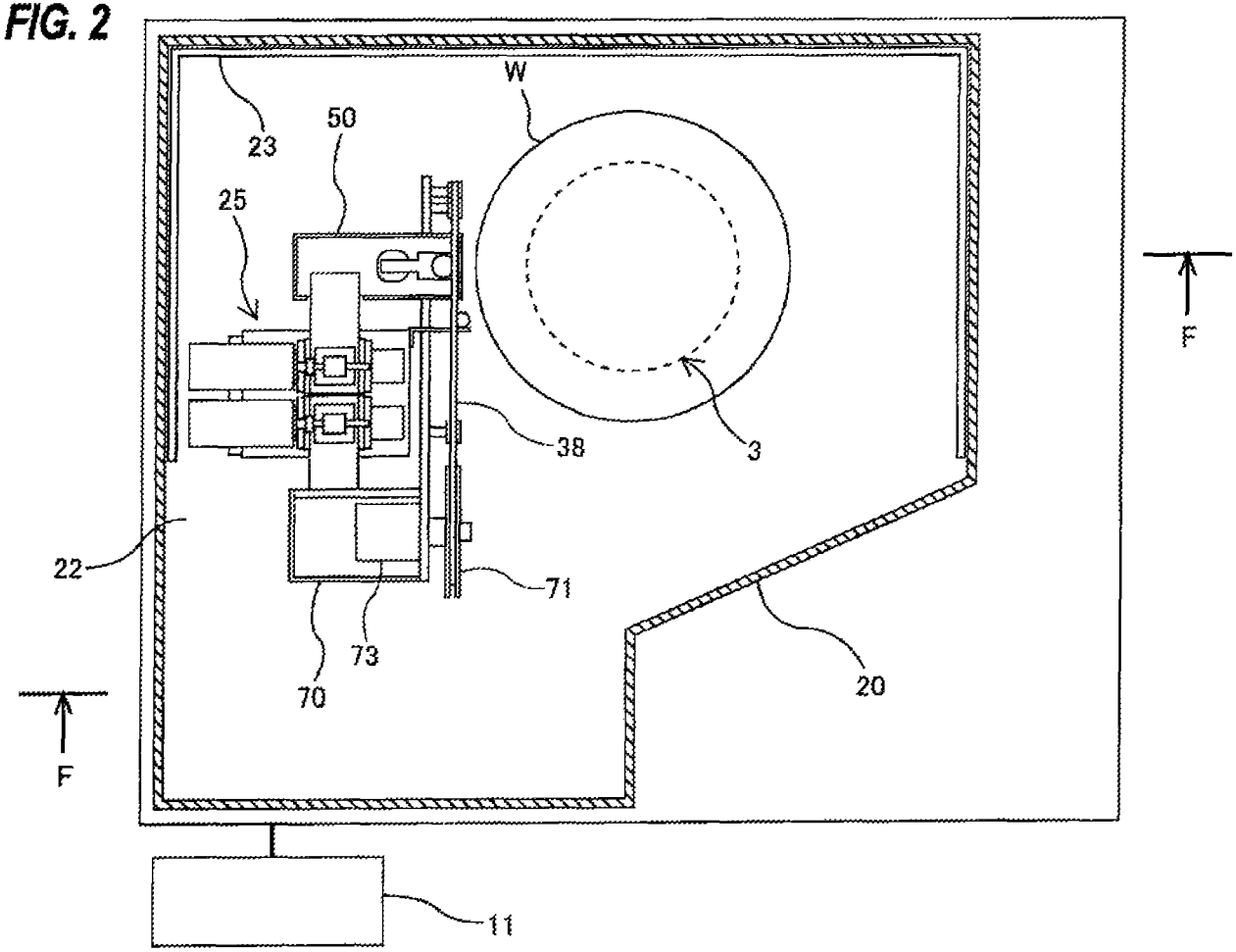
FIG. 2 is a plan view showing a polishing apparatus according to an embodiment of the present invention.
Figure 3:
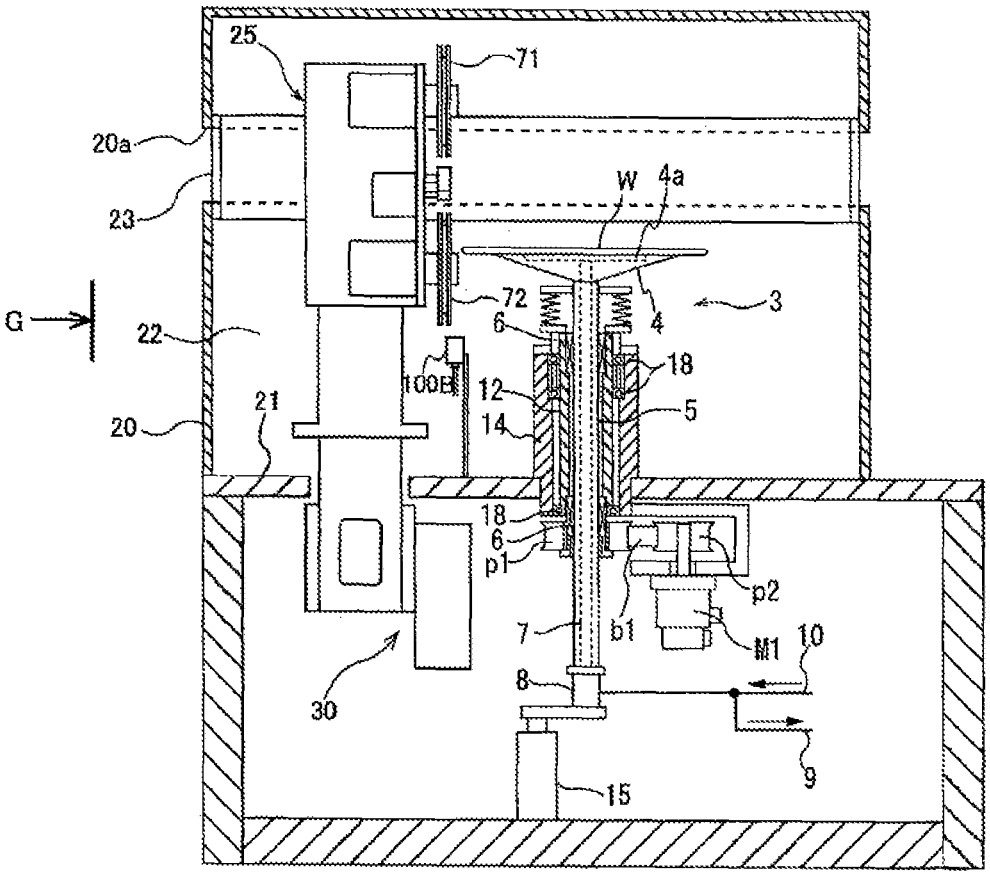
FIG. 3 is a cross-sectional view taken along line F-F in HG. 2.
Figure 4:
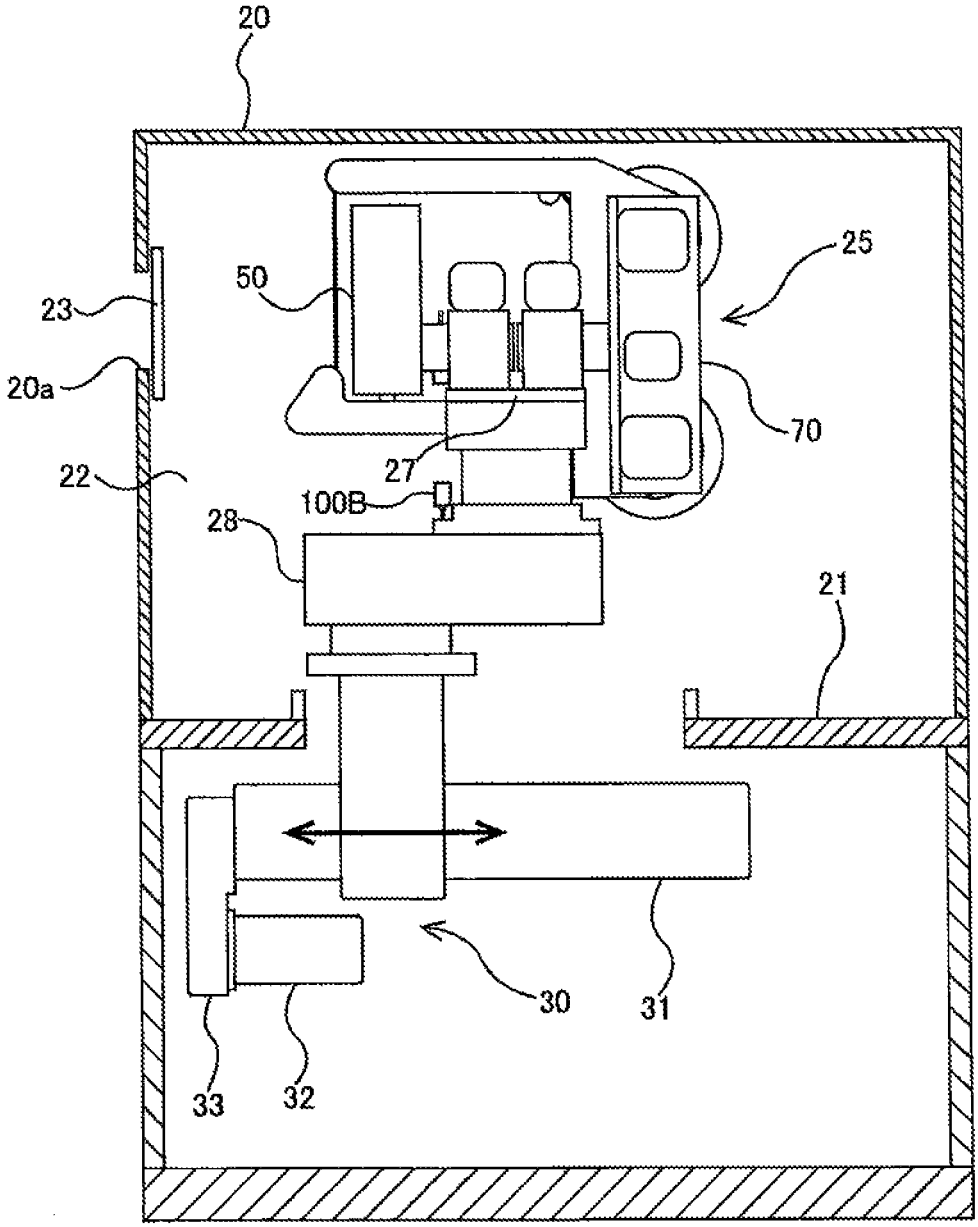
FIG. 4 is a view from a direction indicated by an arrow G in FIG. 3.

FIG. 2 is a plan view showing a polishing apparatus according to an embodiment of the present invention, FIG. 3 is a cross-sectional view taken along line F-F in FIG. 2, and FIG. 4 is a view from a direction indicated by an arrow G in FIG. 3. The polishing apparatus which will be described below is configured to polish a peripheral portion of a substrate, but the present invention can also be applied to a polishing apparatus and a polishing method for polishing a reverse surface of the substrate.

The polishing apparatus according to the embodiment of the present invention includes a substrate holder 3 configured to hold a substrate W as an object to be polished horizontally and to rotate the substrate W. FIG. 2 shows a state in which the substrate holder 3 holds the substrate W. The substrate holder 3 has a holding stage 4 configured to hold a lower surface of the substrate W by vacuum suction, a hollow shaft 5 coupled to a central portion of the holding stage 4, and a motor M1 for rotating the hollow shaft 5. The substrate W is placed onto the holding stage 4 such that a center of the substrate W is aligned with a central axis of the hollow shaft 5. The holding stage 4 is located in a polishing chamber 22 that is defined by a partition 20 and a base plate 21.

The hollow shaft 5 is supported by ball spline bearings (i.e., linear motion bearings) 6 which allow the hollow shaft 5 to move vertically. The holding stage 4 has an upper surface with grooves 4*a*. These grooves 4*a* communicate with a communication passage 7 extending through the hollow shaft 5. The communication passage 7 is coupled to a vacuum line 9 via a rotary joint 8 provided on a lower end of the hollow shaft 5. The communication passage 7 is also coupled to a nitrogen-gas supply line 10 for use in releasing the substrate W from the holding stage 4 after processing of the substrate W. By switching the connection of the communication passage 7 between the vacuum line 9 and the nitrogen-gas supply line 10, the substrate W can be held on the upper surface of the holding stage 4 by vacuum suction and can be released from the upper surface of the holding stage 4.

A pulley p1 is coupled to the hollow shaft 5, and a pulley p2 is mounted on a rotational shaft of the motor M1. The hollow shaft 5 is rotated by the motor M1 through the pulley p1, the pulley p2, and a belt b1 wound on these pulleys p1 and p2. The ball spline bearing 6 serves as a bearing that allows the hollow shaft 5 to move freely in its longitudinal direction. The ball spline bearings 6 are secured to a cylindrical casing 12. Therefore, the hollow shaft 5 can move linearly up and down relative to the casing 12, and the hollow shaft 5 and the casing 12 rotate in unison. The hollow shaft 5 is coupled to an air cylinder (elevating mechanism) 15, so that the hollow shaft 5 and the holding stage 4 are elevated and lowered by the air cylinder 15.

Radial bearings 18 are provided between the casing 12 and a cylindrical casing 14 disposed concentrically around the casing 12, so that the casing 12 is rotatably supported by the radial bearings 18. With these structures, the substrate holder 3 can rotate the substrate W about its central axis and can elevate and lower the substrate W along its central axis.

A polishing unit 25 for polishing a peripheral portion of the substrate W is provided radially outwardly of the substrate W held by the substrate holder 3. This polishing unit 25 is located in the polishing chamber 22. As shown in FIG. 4, the polishing unit 25 in its entirety is secured to a mount base 27, which is coupled to a polishing-unit moving mechanism 30 via an arm block 28.

The polishing-unit moving mechanism 30 has a ball screw mechanism 31 that holds the arm block 28 slidably, a motor 32 for driving the ball screw mechanism 31, and a power transmission mechanism 33 that couples the ball screw mechanism 31 and the motor 32 to each other. The power transmission mechanism 33 is constructed by pulleys, a belt, and the like. As the motor 32 operates, the ball screw mechanism 31 moves the arm block 28 in directions indicated by a double headed arrow in FIG. 4 to thereby move the polishing unit 25 in its entirety in a tangential direction of the substrate W. This polishing-unit moving mechanism 30 also serves as an oscillation mechanism for oscillating the polishing unit 25 at a predetermined amplitude and a predetermined speed.

The polishing unit 25 includes a polishing head 50 for polishing the peripheral portion of the substrate W using a polishing tape 38, and a polishing-tape supply and collection mechanism 70 for supplying the polishing tape 38 to the polishing head 50 and collecting the polishing tape 38 from the polishing head 50. The polishing head 50 constitutes a top-edge polishing head for polishing the top edge portion of the substrate W by pressing a polishing surface of the polishing tape 38 down against the peripheral portion of the substrate W.

Figure 5:
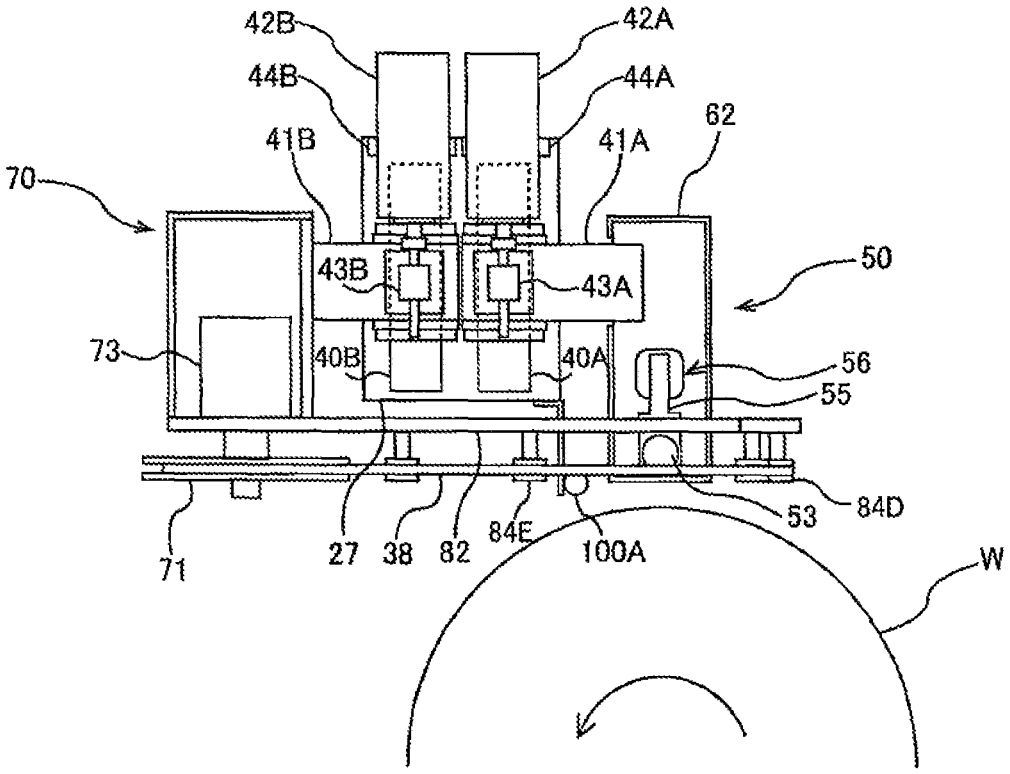
FIG. 5 is a plan view of a polishing head and a polishing-tape supply and collection mechanism.
Figure 6:
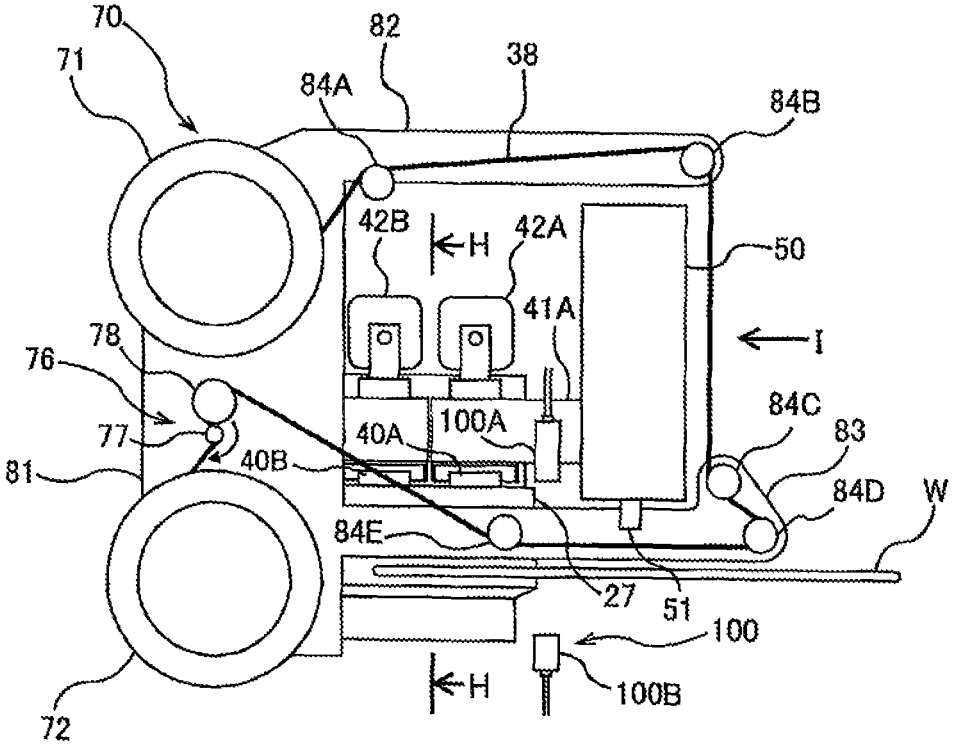
FIG. 6 is a front view of the polishing head and the polishing-tape supply and collection mechanism.
Figure 7:
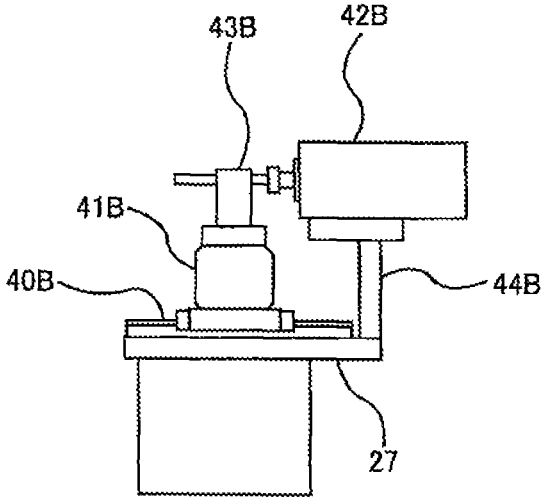
FIG. 7 is a cross-sectional view taken along line H-H in FIG. 6.
Figure 8:
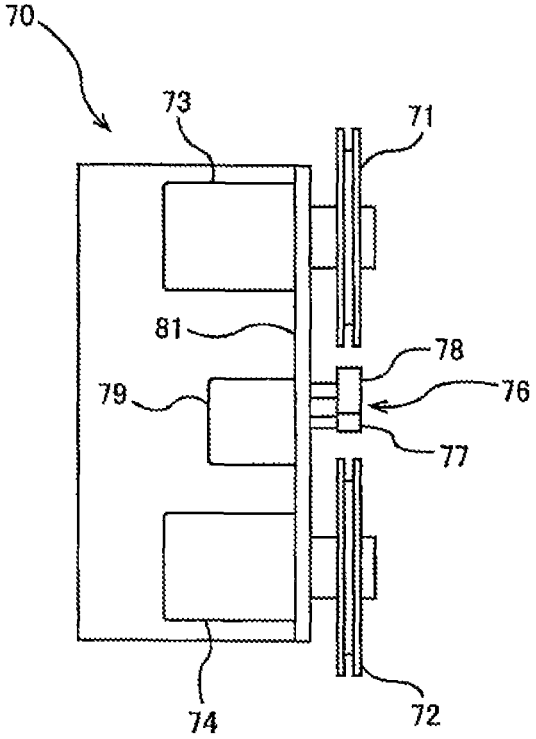
FIG. 8 is a side view of the polishing-tape supply and collection mechanism shown in FIG. 6.

FIG. 5 is a plan view of the polishing head 50 and the polishing-tape supply and collection mechanism 70, FIG. 6 is a front view of the polishing head 50 and the polishing-tape supply and collection mechanism 70, FIG. 7 is a cross-sectional view taken along line H-H in FIG. 6, and FIG. 8 is a side view of the polishing-tape supply and collection mechanism 70 shown in FIG. 6.

Two linear motion guides 40A and 40B, which extend parallel to the radial direction of the substrate W, are disposed on the mount base 27. The polishing head 50 and the linear motion guide 40A are coupled to each other via a coupling block 41A. Further, the polishing head 50 is coupled to a motor 42A and a ball screw 43A for moving the polishing head 50 along the linear motion guide 40A (i.e., in the radial direction of the substrate W). More specifically, the ball screw 43A is secured to the coupling block 41A, and the motor 42A is secured to the mount base 27 through a support member 44A. The motor 42A is configured to rotate a screw shaft of the ball screw 43A, so that the coupling block 41A and the polishing head 50 (which is coupled to the coupling block 41A) are moved along the linear motion guide 40A. The motor 42A, the ball screw 43A, and the linear motion guide 40A constitute a first moving mechanism for moving the polishing head 50 in the radial direction of the substrate W held on the substrate holder 3.

Similarly, the polishing-tape supply and collection mechanism 70 and the linear motion guide 40B are coupled to each other via a coupling block 41B. Further, the polishing-tape supply and collection mechanism 70 is coupled to a motor 42B and a ball screw 43B for moving the polishing-tape supply and collection mechanism 70 along the linear motion guide 40B (i.e., in the radial direction of the substrate W). More specifically, the ball screw 43B is secured to the coupling block 41B, and the motor 42B is secured to the MUM base 27 through a support member 44B. The motor 42B is configured to rotate a screw shaft of the ball screw 43B, so that the coupling block 41B and the polishing-tape supply and collection mechanism 70 (which is coupled to the coupling block 41B) are moved along the linear motion guide 40B. The motor 42B, the ball screw 43B, and the linear motion guide 40B constitute a second moving mechanism for moving the polishing-tape supply and collection mechanism 70 in the radial direction of the substrate W held on the substrate holder 3. The first moving mechanism and the second moving mechanism are configured to be operable independently from each other.

As shown in FIG. 6, the polishing-tape supply and collection mechanism 70 has a supply reel 71 for supplying the polishing tape 38 to the polishing head 50 and a collection reel 72 for collecting the polishing tape 38 from the polishing head 50. The supply reel 71 and the collection reel 72 are coupled to tension motors 73 and 74, respectively (see FIG. 8). These tension motors 73 and 74 are configured to apply predetermined torque to the supply reel 71 and the collection reel 72 to thereby exert a predetermined tension on the polishing tape 38.

A polishing-tape advancing mechanism 76 is provided between the supply reel 71 and the collection reel 72. This polishing-tape advancing mechanism 76 has a tape-advancing roller 77 for advancing the polishing tape 38, a nip roller 78 that presses the polishing tape 38 against the tape-advancing roller 77, and a tape-advancing motor 79 for rotating the tape-advancing roller 77. The polishing tape 38 is interposed between the nip roller 78 and the tape-advancing roller 77. By rotating the tape-advancing roller 77 in a direction indicated by an arrow in FIG. 6, the polishing tape 38 is advanced from the supply reel 71 to the collection reel 72.

The tension motors 73 and 74 and the tape-advancing motor 79 are mounted to a pedestal 81. This pedestal 81 is secured to the coupling block 41B. The pedestal 81 has two support arms 82 and 83 extending from the supply reel 71 and the collection reel 72 toward the polishing head 50. A plurality of guide rollers 84A, 84B, 84C, 84D, and 84E for supporting the polishing tape 38 are provided on the support arms 82 and 83. The polishing tape 38 is guided by these guide rollers 84A to 84E so as to surround the polishing head 50. As shown in FIG. 6, the polishing head 50 has a pressing member 51 for pressing the polishing tape 38 against the peripheral portion of the substrate W.

The extending direction of the polishing tape 38 is perpendicular to the radial direction of the substrate W as viewed from above. The two guide rollers 84D and 84E, which are located below the polishing head 50, support the polishing tape 38 such that the polishing surface of the polishing tape 38 is parallel to the surface (upper surface) of the substrate W. Further, the polishing tape 38 extending between these guide rollers 84D and 84E is parallel to the tangential direction of the substrate W. There is a gap in the vertical direction between the polishing tape 38 and the substrate W.

The polishing apparatus further has a tape-edge detection sensor 100 for detecting a position of the edge of the polishing tape 38. The tape-edge detection sensor 100 is a transmission optical sensor. The tape-edge detection sensor 100 has a light emitter 100A and a light receiver 100B. The light emitter 100A is secured to the mount base 27 as shown in FIG. 5, and the light receiver 100B is secured to the base plate 21 that defines the polishing chamber 22 as shown in FIG. 3. This tape-edge detection sensor 100 is configured to detect the position of the edge of the polishing tape 38 based on a quantity of the light received by the light receiver 100B.

Figure 9:
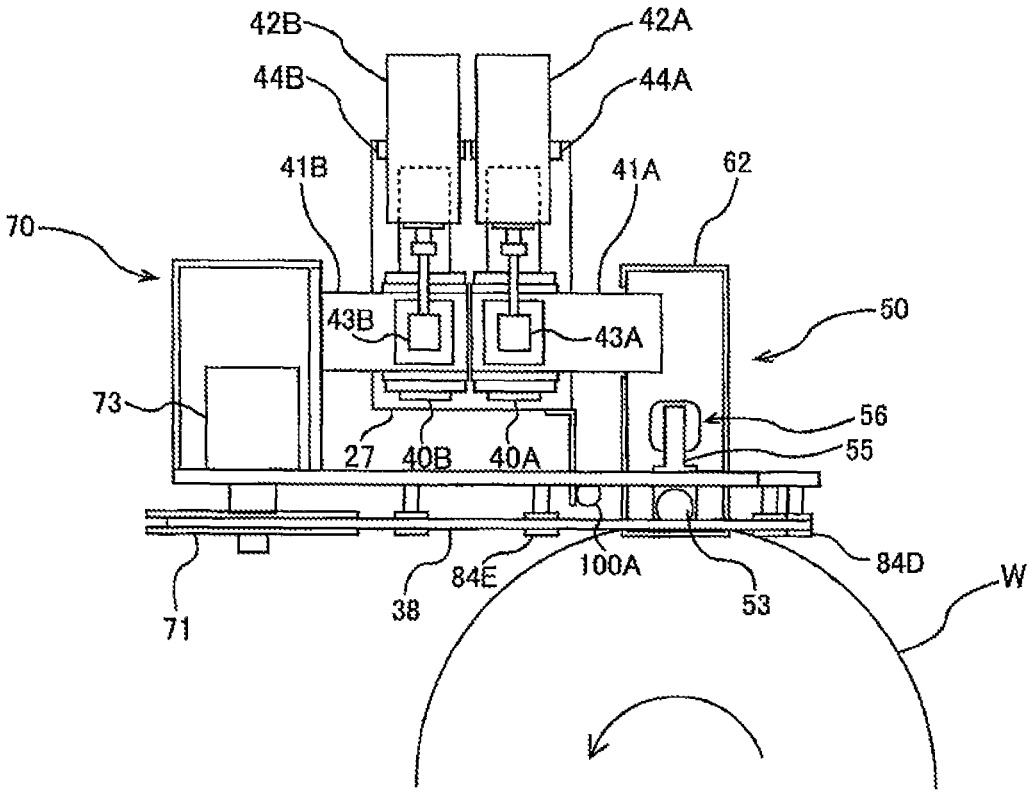
FIG. 9 is a view showing the polishing head and the polishing-tape supply and collection mechanism that have been moved to a predetermined processing position.
Figure 10:
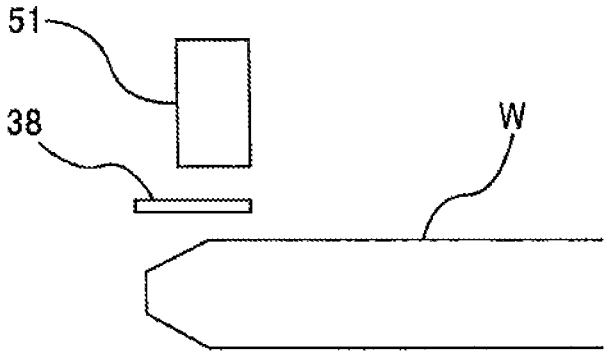
FIG. 10 is a schematic view of a pressing member, a polishing tape, and the substrate at the processing position as viewed from the lateral direction.

As shown in FIG. 9, in order to polishing the substrate W, the polishing head 50 and the polishing-tape supply and collection mechanism 70 are moved from a retracted position shown in FIG. 5 to a predetermined processing position, respectively, by the motors 42A and 42B and the ball screws 43A and 43B. More specifically, the polishing head 50 and the polishing-tape supply and collection mechanism 70 are moved such that the pressing member 51 of the polishing head 50 is located directly above the polishing tape 38 as shown in FIG. 10.

Next, polishing operations of the polishing apparatus having the above-described structures will be described. The operations of the polishing apparatus are controlled by an operation controller 11 shown in FIG. 2. The substrate W is held by the substrate holder 3 such that a film (e.g., a device layer) formed on the surface thereof faces upward, and further the substrate W is rotated about its central axis. A liquid (e.g., pure water) is supplied to the center of the rotating substrate W from the liquid supply mechanism (not shown in the drawings). The pressing member 51 of the polishing head 50 presses the polishing tape 38 against the peripheral portion of the substrate W. The peripheral portion of the substrate W is polished by the sliding contact between the rotating substrate W and the polishing tape 38. The polishing tape 38 that is polishing the substrate W extends in the tangential direction of the substrate W as shown in FIG. 9.

Figure 11:
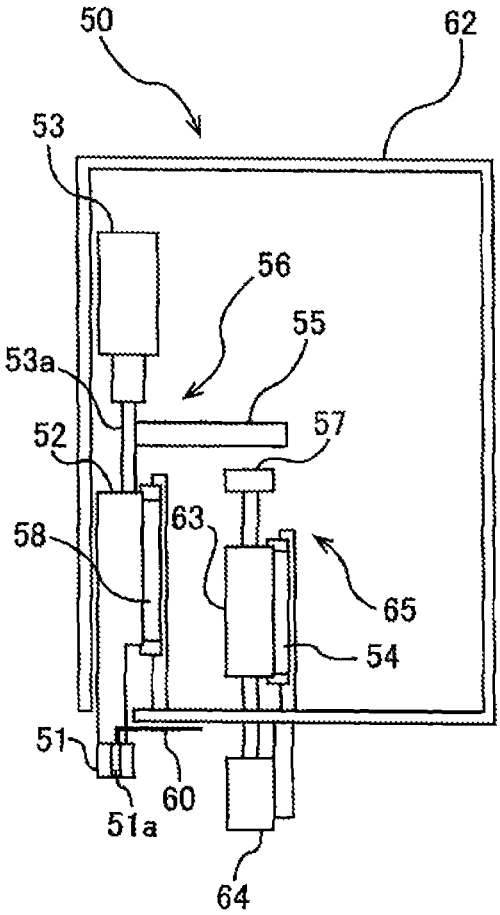
FIG. 11 is a vertical cross-sectional view of the polishing head as viewed from a direction indicated by an arrow 1 FIG. 6.

Next, the details of the polishing head 50 will be described. FIG. 11 is a vertical cross-sectional view of the polishing head 50 as viewed from a direction indicated by an arrow 1 in FIG. 6. As shown in FIG. 11, the polishing head 50 has a pressing member 51 for pressing the polishing tape 38 against the substrate W, a pressing member holder 52 for holding the pressing member 51, a pressing force control mechanism 56 for controlling a pressing force of the pressing member 51, and a polishing position limiting mechanism 65 for limiting a polishing position of the pressing member 51. The pressing member holder 52 is vertically movably supported by a linear motion guide 58 extending in the vertical direction. The pressing member 51 has through-holes 51*a* extending in the vertical direction. A vacuum line 60 is coupled to the through-holes 51*a*. This vacuum line 60 has a valve (not shown in the drawings) therein. By opening this valve, a vacuum is produced in the through-holes 51*a* of the pressing member 51. When the vacuum is produced in the through-holes 51*a* with the pressing member 51 in contact with an upper surface of the polishing tape 38, this upper surface of the polishing tape 38 is held on a lower surface of the pressing member 51.

The pressing force control mechanism 56 has an air cylinder 53 as an actuator configured to push down the pressing-member holder 52 and the pressing member 51. A force for allowing the pressing member 51 to press the polishing tape 38 against the substrate W, is generated by the air cylinder 53. A positioning member 55 which moves vertically together with the pressing member 51 is fixed to a piston rod 53*a* of the air cylinder 53. The polishing position limiting mechanism 65 is disposed below the positioning member 55. The polishing position limiting mechanism (a position limiter) 65 has a stopper 57 for limiting a downward movement of the positioning member 55 (i.e., the downward movement of the pressing member 51), a ball screw mechanism 63 for elevating and lowering the stopper 57, and a servomotor 64 for driving the ball screw mechanism 63. The ball screw mechanism 63 and the servomotor 64 constitute a stopper moving mechanism (an actuator) for moving the stopper 57. The operation controller 11 is configured to detect that the positioning member 55 is brought into contact with the stopper 57 during polishing of the substrate W.

The stopper 57 is located below the positioning member 55. When the positioning member 55 is brought into contact with the stopper 57, the position and the movement of the positioning member 55 (i.e., the position and the movement of the pressing member 51) is limited. The stopper 57 is fixed to the ball screw mechanism 63, which is supported vertically movably by a linear motion guide 54 extending in the vertical direction. When the servomotor 64 is driven, the ball screw mechanism 63 and the stopper 57 are elevated and lowered along the linear motion guide 54.

The positioning member 55 is coupled to the pressing member 51 via the piston rod 53*a* and the pressing member holder 52. Therefore, the positioning member 55 moves together with the pressing member 51. In FIG. 11, although the positioning member 55 is attached to the piston rod 53*a*, if the positioning member 55 is located above the stopper 57, the positioning member 55 may be attached to the pressing member holder 52.

The pressing member holder 52, the air cylinder 53, the positioning member 55, the stopper 57, and the ball screw mechanism 63 are housed in a box 62. A lower portion of the pressing member holder 52 projects from a bottom of the box 62, and the pressing member 51 is attached to the lower portion of the pressing member holder 52.

Figure 12:
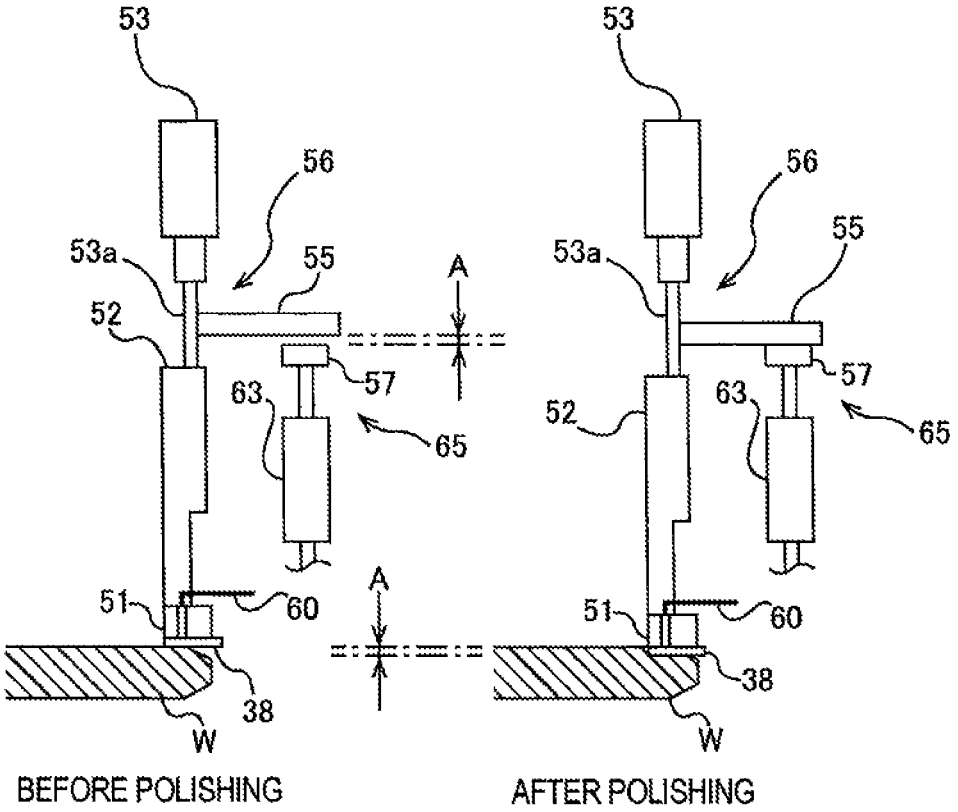
FIG. 12 is a view showing a pressing force control mechanism and a polishing position limiting mechanism before and after polishing of the substrate.
Figure 13A:
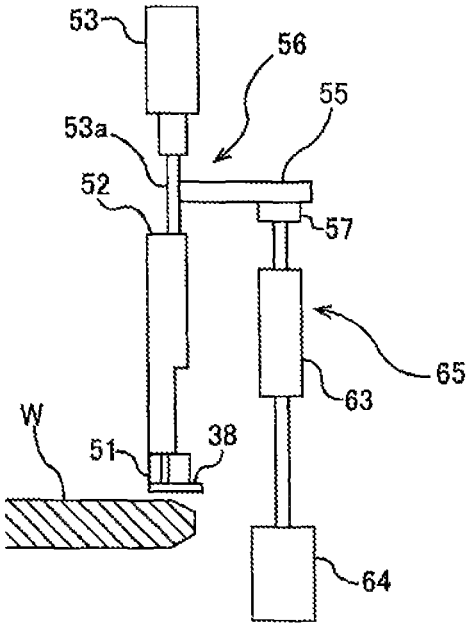
FIG. 13A is a view showing a state in which the positioning member is in contact with the stopper.
Figure 13B:
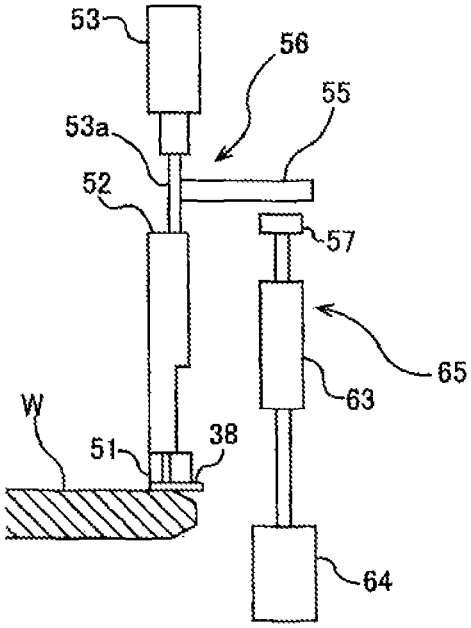
FIG. 13B is a view showing a state in which the positioning member is separated from the stopper.

As shown in FIG. 12, when a gas such as an air is supplied from a gas supply source (not shown) to the air cylinder 53, the piston rod 53*a* is lowered to lower the pressing member holder 52. The pressing member 51 is moved downward along the linear motion guide 58 together with the pressing member holder 52 to press the polishing tape 38 against the peripheral portion of the substrate W. The substrate W is polished by sliding contact with the polishing tape 38. As the substrate W is polished, the pressing member 51 is lowered, and the positioning member 55 is brought into contact with the stopper 57. After the positioning member 55 is brought into contact with the stopper 57, the pressing member 51 is not lowered any further. Therefore, when the positioning member 55 is brought into contact with the stopper 57, the polishing of the substrate W is substantially completed. In this manner, the lowered position of the pressing member 51, i.e., the polishing position of the pressing member 51 is limited by the stopper 57, and thus a polishing amount of the substrate W is controlled. In this specification, a polishing amount represents a thickness of a material removed from a surface of a substrate by polishing of the substrate.

As shown in FIG. 12, a distance "A" between the positioning member 55 when the polishing tape 38 is brought into contact with the substrate W and the stopper 57 corresponds to a target polishing amount "A" of the substrate W. The stopper 57 is lowered by the distance "A" by the servomotor 64 and the ball screw mechanism 63, and the polishing of the substrate W is started in this state.

In order to polish the substrate W accurately by a predetermined target polishing amount, it is necessary to determine a polishing start point. Therefore, a method for determining the polishing start point will be described with reference to FIG. 13A and FIG. 13B. First, the stopper 57 is elevated by the servomotor 64, or the positioning member 55 is lowered by the air cylinder 53 to bring the positioning member 55 and the stopper 57 into contact with each other (see FIG. 13A). Then, while the positioning member 55 and the stopper 57 are held in contact with each other, the positioning member 55 and the stopper 57 are lowered by the air cylinder 53 and the servomotor 64, and the polishing tape 38 and the pressing member 51 are moved toward the peripheral portion of the substrate W. At this time, the polishing tape 38, the pressing member 51, the positioning member 55, and the stopper 57 are moved together. At the moment when the polishing tape 38 is brought into contact with the peripheral portion of the substrate W, the stopper 57 is separated from the positioning member 55 (see FIG. 13B). The position of the stopper 57 at this moment is an initial position of the stopper 57, and this initial position is determined as a polishing start position.

Figure 14:
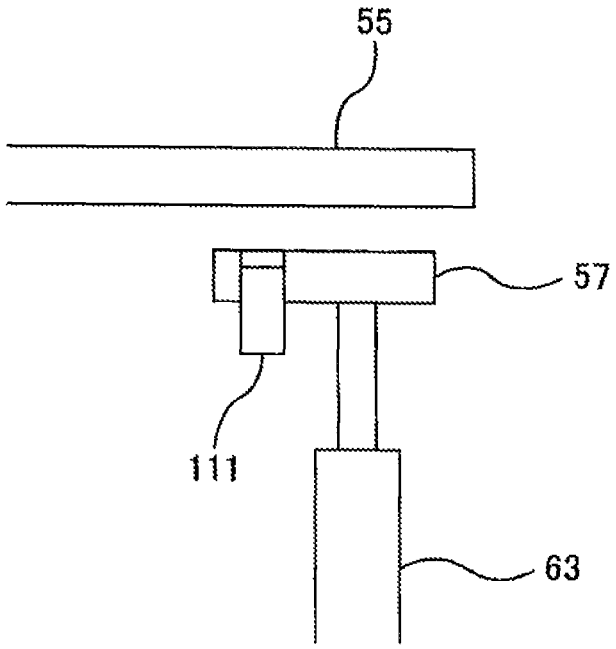
FIG. 14 is a view showing an example of using a distance sensor as a contact sensor.

The moment when the stopper 57 is separated from the positioning member 55 can be determined from a change in the output signal of a contact sensor such as a distance sensor or a displacement sensor. FIG. 14 is a view showing an example of using a distance sensor 111 as the contact sensor. As shown in FIG. 14, the distance sensor 111 is fixed to the stopper 57, and is arranged to measure a distance between the stopper 57 and the positioning member 55. The moment when the stopper 57 is separated from the positioning member 55 can be determined from a change in the output signal of the distance sensor 111. The distance sensor 111 may be provided on the positioning member 55.

Figure 15A:
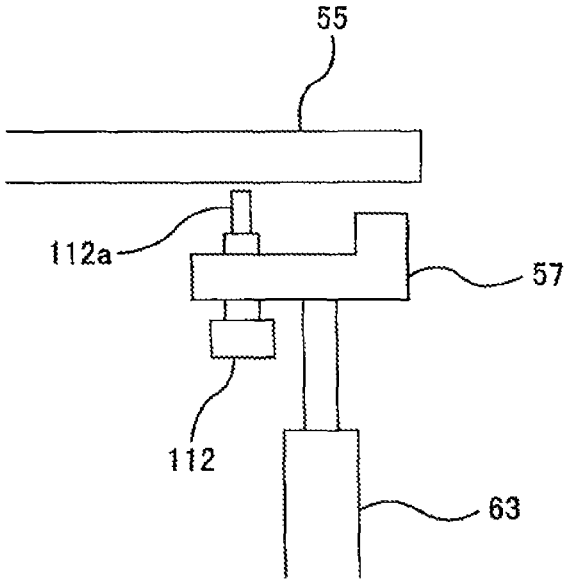
FIG. 15A and FIG. 15B are views showing an example of using a displacement sensor as the contact sensor.
Figure 15B:
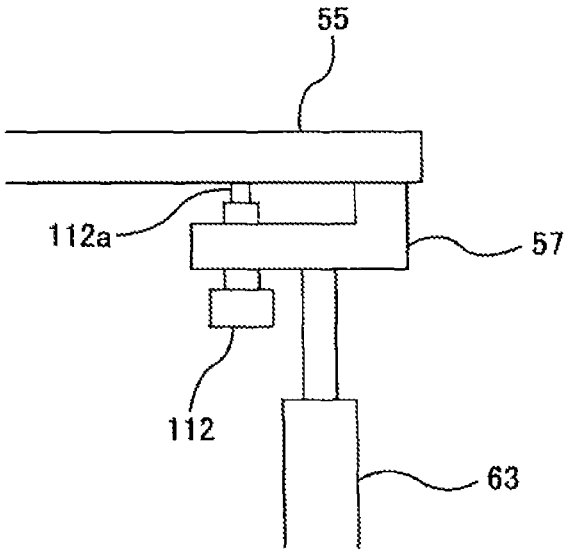

FIG. 15A and FIG. 15B are views showing an example of using a displacement sensor 112 as the contact sensor. As shown in FIG. 15A, the displacement sensor 112 is fixed to the stopper 57. The displacement sensor 112 has a contactor 112*a* projecting upward from the stopper 57, and is configured to output the displacement of the contactor 112*a* with respect to the stopper 57. FIG. 15A shows a state in which the stopper 57 is separated from the positioning member 55, and FIG. 15B shows a state in which the stopper 57 is in contact with the positioning member 55. As can be seen from FIG. 15A and FIG. 15B, when the stopper 57 is separated from the positioning member 55, the contactor 112*a* is displaced. Therefore, the moment when the stopper 57 is separated from the positioning member 55 can be determined from a change in the output signal of the displacement sensor 112. The displacement sensor 112 may be provided on the positioning member 55.

The operation controller 11 is capable of detecting whether or not the positioning member 55 is brought into contact with the stopper 57 during polishing of the substrate W, from the output signal of the above contact sensor (the distance sensor 111 or the displacement sensor 112). For example, if the positioning member 55 is not brought into contact with (does not reach) the stopper 57 within a preset polishing time (i.e., polishing of the substrate W is not terminated), the operation controller 11 preferably generates an alarm signal.

Figure 16:
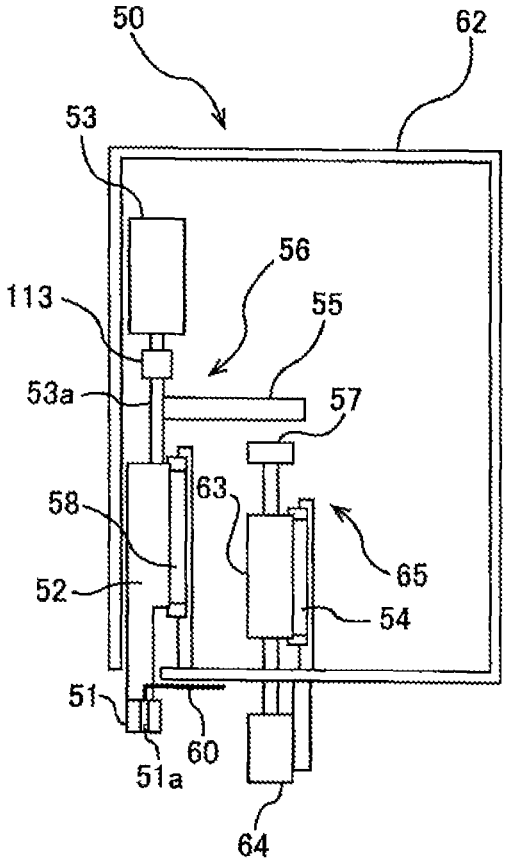
FIG. 16 is a view showing the polishing head having a load cell.

The polishing start point may be determined using a load sensor (for example, a load cell). Specifically, as shown in FIG. 16, a load cell 113 is incorporated in the piston rod 53*a* of the air cylinder 53. When the positioning member 55 and the stopper 57 are lowered while the positioning member 55 and the stopper 57 are held in contact with each other in the same manner as described above, the load cell 113 detects a change in load at the moment when, the polishing tape 38 is brought into contact with the peripheral portion of the substrate W. The initial position of the stopper 57 at the moment when the polishing tape 38 is brought into contact with the peripheral portion of the substrate W is determined as the polishing start point. The load cell 113 may be arranged on the pressing member 51 or the pressing member holder 52.

The stopper 57 is lowered by the servomotor 64 by a distance corresponding to the target polishing amount of the substrate W from the initial position of this stopper 57. Then, the substrate W is polished until the positioning member 55 is brought into contact with the stopper 57.

The advantage of limiting the polishing position of the pressing member 51 by making the positioning member 55 contact the stopper 57 is as follows: Namely, in the case where a plurality of films are formed on the substrate W, it is possible to set the target polishing amount of the substrate W with respect to each film. Thus, it is possible to polish the films under the polishing conditions based on hardness of the films or the like. Further, since polishing of the substrate W is terminated when the polishing member 55 is brought into contact with the stopper 57, insufficient polishing or excessive polishing does not occur, and an error does not occur between the target polishing amount and an actual polishing amount of the substrate W.

It is also possible to polish the substrate W while the pressing member 51 and the stopper 57 are integrally lowered at a predetermined speed in a state where the positioning member 55 is in contact with the stopper 57. In this case also, the polishing position of the pressing member 51 is limited by the stopper 57. Further, in this case, multi-stage polishing of the substrate W in which the polishing process of the substrate W is divided into a plurality of polishing steps may be performed. In this multi-stage polishing, the target polishing amount and a lowering speed (moving speed) of the stopper 57 are set with respect to each polishing step. It is preferable to set the lowering speed of the stopper 57 so that the pressing member 51 is lowered at a speed corresponding to a predetermined target polishing rate for the substrate W. In this embodiment, the polishing rate of the substrate W can be controlled by the lowering speed (moving speed) of the stopper 57.

In order to polish the substrate W under an optimum polishing condition, a rotational speed of the substrate W, a polishing load, and the like may be set for each polishing step, in addition to the lowering speed of the stopper 57. For example, when the chipping and/or peeling is liable to occur in the film of the substrate W, it is preferable to slow down the lowering speed of the stopper 57 or the rotating speed of the substrate W or to reduce the polishing load.

In general, the air cylinder 53 can accurately control a pressing load of the pressing member 51, but cannot accurately control the lowered position of the pressing member 51. Thus, if the pressing member 5 is lowered only by the air cylinder 53, an error occurs in the polishing amount of the substrate W. If the pressing member 51 is lowered by using the servomotor in place of the air cylinder, the polishing tape 38 polishes the film on the substrate W at a preset polishing rate regardless of hardness of the film on the substrate W, and thus there is a high possibility that the chipping occurs. In this embodiment, by using the air cylinder 53, the polishing rate changes automatically in response to hardness of the film. As a result, it is possible to prevent damage to the substrate W such as chipping. Further, since the polishing end point (the lowered position of the pressing member 51) can be accurately adjusted, the polishing amount of the substrate W can be precisely controlled.

Figure 1B:
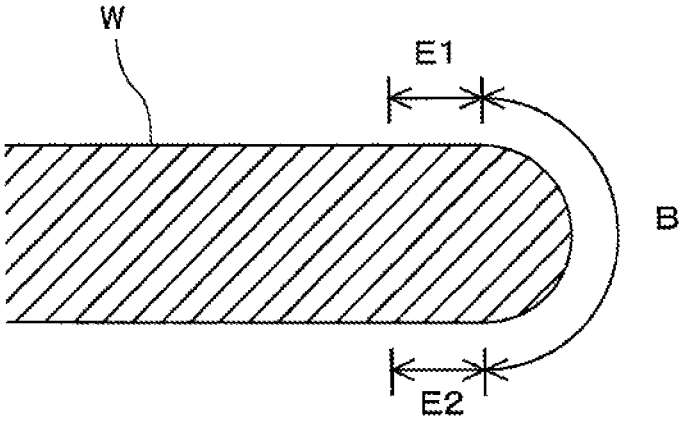

During polishing of the substrate W, a liquid (for example, pure water) is supplied to the central portion of the rotating substrate W, and the substrate W is polished in the presence of the liquid. The liquid supplied to the substrate W spreads throughout the upper surface of the substrate W by a centrifugal force, and thus the polishing debris can be prevented from adhering to the device formed on the substrate W. As described above, during polishing of the substrate W, the polishing tape 38 is held under vacuum suction by the pressing member 51, and thus a relative position between the polishing tape 38 and the pressing member 51 can be prevented from being deviated. Therefore, the polishing shape of the substrate W can be stabilized. Further, even if the polishing load is increased, the relative position between the polishing tape 38 and the pressing member 51 is not deviated, and thus the polishing time can be shortened. Since the polishing tape 38 is pressed from above by the pressing member 51, the top edge portion of the substrate W (see FIG. 1A and FIG. 1B) can be polished. In order to increase the polishing rate of the substrate W, the polishing tape 38 may be oscillated in the tangential direction of the substrate W by the polishing-unit moving mechanism 30 during polishing of the substrate W.

After polishing of the substrate W is completed, the supply of gas to the air cylinder 53 is stopped. At the same time, vacuum suction of the polishing tape 38 is stopped. Then, the polishing head 50 and the polishing-tape supply and collection mechanism 70 are moved from the processing position shown in FIG. 9 to the retracted position shown in FIG. 5. The polished substrate W is raised by the substrate holder 3, and is transported to the outside of the polishing chamber 22 by a hand of the transfer mechanism (not shown in the drawings). Before polishing of a subsequent substrate is started, the polishing tape 38 is fed from the supply reel 71 to the collection reel 72 by a predetermined distance by the polishing-tape advancing mechanism 76. As a result, a new polishing surface is used for polishing of the subsequent substrate. When it is estimated that the polishing tape 38 has been clogged with the polishing debris, the polished substrate W may be polished by a new polishing surface after feeding the polishing tape 38 by a predetermined distance. For example, clogging of the polishing tape 38 can be estimated from the polishing time and the polishing load. The substrate W may be polished while feeding the polishing tape 38 by the polishing-tape advancing mechanism 76 at a predetermined speed. In this case, it is not necessary to hold the polishing tape 38 by vacuum suction. Further, the polishing tape 38 may be fed by the polishing-tape advancing mechanism 76 with the polishing tape 38 held by vacuum suction.

In the embodiment described above, the polishing tape is used as a polishing tool, but the present invention is not limited to the embodiment described above. For example, the present invention can also be applied to a polishing apparatus and a polishing method for grinding a substrate by pressing a grinding wheel as a polishing tool against the substrate. Further, the present invention can also be applied to a polishing apparatus and a polishing method for polishing the reverse surface of the substrate by keeping the polishing tool in sliding contact with the substrate. In this case also, the polishing amount of the substrate can be accurately controlled.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus for polishing a substrate, comprising:

a substrate holder configured to hold a substrate and to rotate the substrate;

a pressing member configured to press a polishing tool against the substrate and to form a polished portion in a surface of the substrate;

a pressing force control mechanism configured to control a pressing force of the pressing member; and a polishing position limiting mechanism configured to limit a depth of the polished portion to less than a thickness of the substrate when the pressing member is pressing the polishing tool against the substrate.

2. The polishing apparatus according to claim 1, further comprising:

a positioning member coupled to the pressing member, the positioning member and the pressing member being integrally movable;

wherein the polishing position limiting mechanism comprises a stopper configured to limit a movement of the positioning member and a stopper moving mechanism configured to move the stopper.

3. The polishing apparatus according to claim 2, wherein an alarm signal is generated when the positioning member is not brought into contact with the stopper within a predetermined polishing time.

4. The polishing apparatus according to claim 1, wherein the pressing force control mechanism comprises an air cylinder configured to apply the pressing force to the pressing member.

5. The polishing apparatus according to claim 1, wherein the polishing position limiting mechanism is configured to limit a distance of a movement of the pressing member from a polishing start point.

6. A polishing apparatus for polishing a substrate, comprising:

a substrate holder configured to hold a substrate and to rotate the substrate;

a pressing member configured to press a polishing tool against the substrate and to polish the substrate;

a pressing force control mechanism configured to control a pressing force of the pressing member;

a polishing position limiting mechanism configured to limit a polishing position of the pressing member; and a positioning member coupled to the pressing member, the positioning member and the pressing member being integrally movable, wherein the polishing position limiting mechanism comprises a stopper configured to limit a movement of the positioning member and a stopper moving mechanism configured to move the stopper, and wherein the stopper moving mechanism comprises a ball screw mechanism and a servomotor configured to operate the ball screw mechanism.

7. A polishing apparatus for polishing a substrate, comprising:

a substrate holder to hold a substrate and to rotate the substrate;

a pressing member to press a polishing tool against the substrate and to form a polished portion in a surface of the substrate;

an actuator to control a pressing force of the pressing member; and a position limiter to limit a depth of the polished portion to less than a thickness of the substrate when the pressing member is pressing the polishing tool against the substrate.

8. The polishing apparatus according to claim 7, further comprising:

a positioning member coupled to the pressing member, the positioning member and the pressing member being integrally movable;

wherein the position limiter comprises a stopper to limit a movement of the positioning member and an actuator to move the stopper.

9. The polishing apparatus according to claim 8, wherein an alarm signal is generated when the positioning member is not brought into contact with the stopper within a predetermined polishing time.

10. The polishing apparatus according to claim 7, wherein the actuator to control the pressing force of the pressing member comprises an air cylinder to apply the pressing force to the pressing member.

11. The polishing apparatus according to claim 7, wherein the position limiter is configured to limit a distance of a movement of the pressing member from a polishing start point.

12. A polishing apparatus for polishing a substrate, comprising:

a substrate holder to hold a substrate and to rotate the substrate;

a pressing member to press a polishing tool against the substrate and to polish the substrate;

an actuator to control a pressing force of the pressing member;

a position limiter to limit a polishing position of the pressing member; and a positioning member coupled to the pressing member, the positioning member and the pressing member being integrally movable, wherein the position limiter comprises a stopper to limit a movement of the positioning member and an actuator to move the stopper, and wherein the actuator to move the stopper comprises a ball screw mechanism and a servomotor to operate the ball screw mechanism.

* * * * *